US005590608A

United States Patent [19]

Yore et al.

[11] Patent Number: 5,590,608

[45] Date of Patent: Jan. 7, 1997

[54] LOCKABLE LOCK BOX MOUNTING ASSEMBLY AND METHOD

[76] Inventors: Thomas S. Yore, 5133 Adair Way, San Jose, Calif. 95124; Jeffrey M. Wright, 1140 Littleoak Dr., San Jose, Calif. 95129

[21] Appl. No.: 407,643

[22] Filed: Mar. 21, 1995

Related U.S. Application Data

[63] Continuation-in-part of Ser. No. 154,708, Nov. 19, 1993, abandoned.

[51] Int. Cl.[6] ..... E05G 1/00

[52] U.S. Cl. ..... 109/50; 70/2; 70/63; 109/52; 232/22; 248/214; 248/552

[58] Field of Search ..... 70/2, 54–56, 58, 70/63; 248/552, 214, 231.51, 300; 109/50–52; 232/1 C, 22, 42

[56] References Cited

U.S. PATENT DOCUMENTS

| | | | |
|---|---|---|---|
| 485,613 | 11/1892 | Deane | 16/82 X |
| 2,023,826 | 12/1935 | Van Buskirk | 232/42 |
| 2,273,580 | 2/1942 | Krushwitz et al. | 232/1 |
| 2,539,935 | 1/1951 | Stephens et al. | 248/226 |
| 3,436,937 | 4/1969 | Barrett | 70/63 |
| 3,712,091 | 1/1973 | Parent | 70/63 |
| 3,744,281 | 7/1973 | Logue et al. | 70/58 |
| 3,934,434 | 1/1976 | Law | 70/63 |
| 4,096,718 | 6/1978 | Michelman et al. | 70/63 |
| 4,286,814 | 9/1981 | Harrington et al. | 292/281 |
| 4,463,584 | 8/1984 | De Forrest | 70/63 |
| 4,494,690 | 1/1985 | Dupuis | 232/22 |
| 4,532,783 | 8/1985 | Maurice | 70/63 |
| 4,535,612 | 8/1985 | Seremet | 70/56 |
| 4,609,780 | 9/1986 | Clark | 179/2 A |
| 4,641,505 | 2/1987 | Maurice | 70/63 |
| 4,694,668 | 9/1987 | Ciletti et al. | 70/63 |
| 4,703,850 | 11/1987 | Walker | 206/293 |
| 4,746,062 | 5/1988 | Bartylla | 232/1 C |
| 4,854,016 | 8/1989 | Rice | 24/495 |
| 4,961,329 | 10/1990 | Anderson | 70/2 |
| 5,046,339 | 9/1991 | Krell | 70/55 |
| 5,084,945 | 2/1992 | Childers | 24/530 |
| 5,218,846 | 6/1993 | Cook et al. | 70/56 |

*Primary Examiner*—Lloyd A. Gall

*Attorney, Agent, or Firm*—Flehr, Hohbach, Test, Albritton & Herbert

[57] ABSTRACT

A lock box mounting assembly (10, 101) for removably mounting a lock box (12, 116) to the hinge-edge (104) of a door (26, 106) includes a U-shaped bracket (30, 102, 103) formed for placement between the door (26, 106) and the door jamb (28, 107). The U-shaped bracket (30,102, 103) has an outer leg portion (32, 109), an inner leg portion (34, 108), and a central portion (36, 111) formed to extend through a reveal space between the hinge-edge of the door (26, 106) and the door jamb (28, 107) when the door is in a closed position. The inner leg portion (34) preferably includes at least one hinge-receiving slot (**52*a*, 52*b*, 118) dimensioned to receive a door hinge (58,117) for vertically supporting the U-shaped bracket (30, 102, 103) on a door hinge (58, 117). In one form of the mounting assembly (101) the brackets (102, 103) substantially encircle and are locked to the door hinge (117**) for increased security.

37 Claims, 7 Drawing Sheets

LOCKABLE LOCK BOX MOUNTING ASSEMBLY AND METHOD

RELATED APPLICATION

This application is a continuation-in-part application based on application Ser. No. 08/154,708, filed Nov. 19, 1993, entitled "LOCK BOX MOUNTING ASSEMBLY now abandoned ".

TECHNICAL FIELD

This invention relates to a novel lock box mounting assembly for use with a lock box in connection with the showing of real estate property to selectively allow access to listed real estate property. More specifically, this invention relates to a lock box mounting bracket for mounting a lock box to the door of a building or dwelling, particularly homes.

BACKGROUND ART

Lock boxes enable limited access to premises so that authorized persons, such as repairmen, servicemen, or realtors, may enter the premises to perform their service when the occupant of the premises is not present. Lock boxes are extensively used in the real estate industry in connection with the showing of real estate property to prospective purchasers. It is impractical and undesirable to provide each real estate agent with a key to the listed property. In addition, requiring an agent to obtain a key from the real estate sales office prior to showing each property is somewhat inconvenient. Lock boxes provide a solution to these problems.

A lock box generally includes a hollow box in which the key for a listed property may be placed. Lock boxes are typically provided by a realtor entrusted with the sale of the property. The realtor secures the lock box to the property so that a key to the home is always on the premises in a locked, safe place. The local real estate board may then issue keys to the lock box to board-participating realtor. Agents having a lock box key arrive at a home, open the lock box to access the homeowner's key, and then use the homeowner's key to open the door and show the home.

Lock boxes have been designed to mount to the doorknob of the front door to the home. This type of lock box generally comprises a hollow key receptacle mounted by a shackle to the doorknob. Examples of such lock box assemblies are those disclosed in U.S. Pat. Nos. 3,436,937, 4,532,783; 4,609,780; and 4,641,505. However, these doorknob-mounted lock box assemblies often cause structural damage to the door. As the door is closed, the centrifugal force of the closing door may swing the lock box into the door, marring the doorknob and denting or otherwise damaging the door and door jamb.

In order to try to minimize the possible damage to doorknob-mounted lock boxes, shielding structures and stabilizing brackets for such lock boxes have been devised, for example, as shown in U.S. Pat. Nos. 5,218,846 and 5,084,945, respectively. Nevertheless, doorknob-mounted lock boxes frequently interfere with operation of the doorknob, causing the homeowner inconvenience.

A lock box having a light weight, flexible, shock-absorbing cover was designed, as disclosed in U.S. Pat. No. 5,046,339. Although this lock box assembly minimizes the marking, denting, or other damage caused by the lock box, the lock box assembly is still bulky and cumbersome, making it difficult for a real estate agent to open the door.

As a result of these problems, lock boxes designed for doorknob mounting are often mounted to other structures, for example, by chaining them to posts, water pipes, trees or electrical meters. This causes the realtor to have to hunt through bushes, mud and dirt to find the lock box. Adding to this inconvenience is poor lighting, if any, and the awkward and usually low location of the chain and lock box. Searching for the lock box is often time-consuming, embarrassing for the real estate agent, and disruptive to neighbors. Also, if the agent searches the yard area for the lock box, the agent may track mud and debris into the home.

Another type of lock box assembly is disclosed in U.S. Pat. No. 3,934,434. This lock box includes a bracket which can be mounted on the top of a door. Mounting the lock box over the top of the door, however, places the lock box above a convenient height for an average-sized person to reach. Other examples of doortop-mounted boxes are shown in U.S. Pat. Nos. 4,703,850 and 4,463,584. In addition lock boxes and other box structures are known which have been mounted on a door edge, either the knob edge or the hinge-edge between the door and door jamb. Examples of such structures are the devices shown in U.S. Pat. Nos. 2,023,826; 2,273,580; 4,494,690; 4,694,668; and 4,746,062. Lock box assemblies have also been constructed for attachment to a car to store an ignition key, such as those disclosed in U.S. Pat. Nos. 3,712,091 and 3,744,281.

In addition various door and door lock hardware have been devised to solve specific problems. U.S. Pat. No. 485,613, for example, discloses a hinge lock which prevents opening of the door when mounted on the hinge. U.S. Pat. Nos. 2,539,935 and 4,854,016 disclose table mounting brackets, the latter of which includes a movable clamp. U.S. Pat. Nos. 4,096,718, 4,286,814 and 4,535,612 are directed to lock shielding structures, and U.S. Pat. No. 4,961,329 discloses an improved padlock hasp structure.

While these prior art structures have provided many advantages, the doorknob-mounted structures have interfered with door operation and/or marred the door. The doortop brackets are awkward or impossible for short people to use, and the door edge bracket structures have had a common problem. Once the door is opened, they can be removed and thrown away.

One of the biggest security problems in connection with the use of lock boxes is the real estate agents themselves. Agents can present the biggest exposures to burglaries. It is this problem that lock boxes such as are shown in U.S. Pat. No. 4,609,780 seek to address by keeping in a memory device a record of the identity and time of all those opening the lock box. The lock box of U.S. Pat. No. 4,609,780 is effective in this task as locked to the doorknob, but it has the disadvantages of doorknob-mounted systems if placed on prior art door edge mounting brackets. Once the door is opened, the agent-burglar simply destroys or disposes of the lock box assembly and/or its memory.

Accordingly, it is an object of the present invention to provide a mounting assembly or bracket and method which will not damage doors, is easy to use and yet is securely locked to the door so as to provide enhanced security.

It is another object of the invention to provide a lock box mounting bracket which is easily mounted and locked on a homeowner's door in a clearly visible place, and yet will not interfere with door operation.

It is another object of the invention to provide a lockable lock box mounting assembly which securely mounts a lock box to a homeowner's door and will not mar or dent the door, doorknob, door jamb, or cause other structural damage as the door is opened and shut.

It is a further object of the invention to provide a lockable lock box mounting assembly and method which may be securely attached to a door so that the lock box may not be removed by parties authorized to open the lock box.

It is yet a further object of the invention to provide a lockable lock box assembly which does not awkwardly dangle from the doorknob and complicate entry into the premises.

It is still a further object of the invention to provide a lock box mounting assembly which is durable, weather-resistant, easily manufactured, structurally sound, and may be constructed from light-weight material.

DISCLOSURE OF INVENTION

A preferred embodiment of the invention which is intended to accomplish at least some of the foregoing objects includes a lock box mounting or bracket assembly for removably mounting a lock box to the hinge-edge of a door. The subject lock box mounting assembly preferably has a U-shaped bracket formed for placement between the door and the door jamb. The U-shaped bracket has an outer leg portion, an inner leg portion, and a central portion which connects the inner leg portion and the outer leg portion. The central connecting portion is formed to extend through a reveal space between the hinge-edge of the door and the door jamb when the door is in a closed position. The inner leg portion preferably includes at least one of a hinge-receiving slot and a protrusion structure dimensioned to receive a door hinge for vertically supporting the U-shaped bracket on a door hinge and formed for opening of the door while the bracket is supported on the door hinge.

In order to provide security, the bracket assembly is formed to encircle a sufficient portion of the hinge, and is formed to be secured to the hinge, so as to prevent removal, for example, by locking the hinge bracket assembly components together by the shackle of the lock box to lock the bracket assembly to the hinge.

The present bracket assembly further preferably includes a lock box mounting eye element which extends outwardly from the outer leg portion. In a preferred embodiment, an eye element is provided on two bracket members which are oriented substantially vertically and define horizontally oriented openings dimensioned to receive a lock box shackle member for coupling a lock box to the hinge-edge of the door and simultaneously locking the two bracket members around the hinge. The eye elements may be positioned sufficiently close to an upper edge of the outer leg portion so that, when a lock box is coupled to the eye elements, the lock box does not contact the door. Alternatively, a protective member can be mounted over the eye elements and the lock box shackle used to lock the protective member to the hinge members.

In an alternative embodiment, the outer leg portion includes an outwardly extending, protruding element which aids in preventing the lock box from swinging into the door and marring or denting the door surface.

In a further aspect of the invention a method of mounting a lock box to a door is provided which is comprised, briefly, of the steps of locking a lock box mounting bracket to a door hinge with a first lock assembly carried by the lock box; locking the lock box to the bracket by the first lock assembly; and locking a movable member, such as the lock box key box door, to the lock box in a closed position using a second lock assembly differing from the first lock assembly.

BRIEF DESCRIPTION OF THE DRAWING

Other objects and advantages of the present invention will become apparent from the following detailed description of a preferred embodiment thereof taken in conjunction with the accompanying drawings.

BEST MODE OF CARRYING OUT THE INVENTION

The lock box mounting bracket assembly can be embodied in a non-lockable bracket which is mounted to the hinge-edge of a door, as shown in FIGS. 1–6, or in a bracket assembly which can be locked to the door hinge, as shown in FIGS. 7–11.

Figure 1:
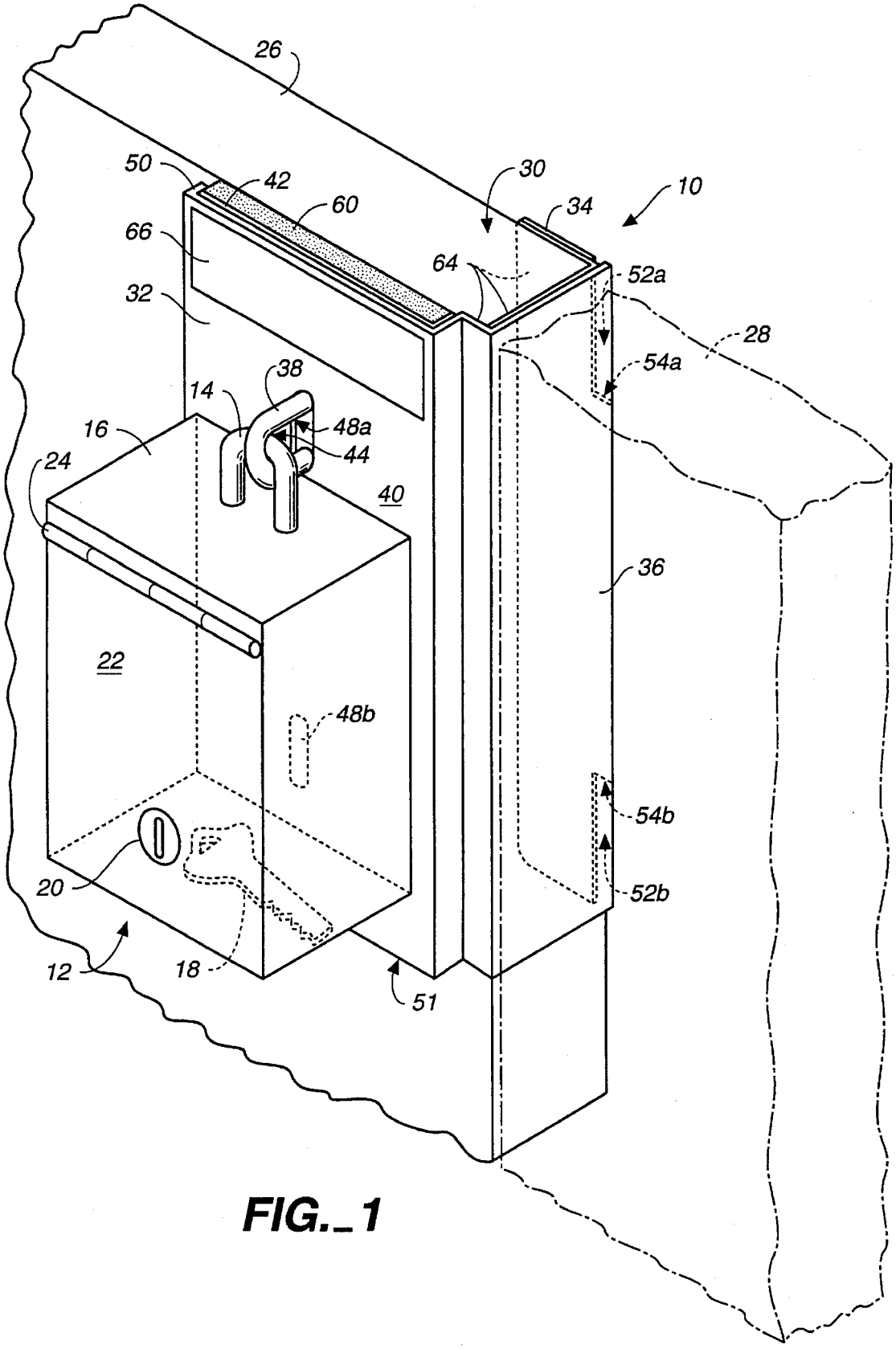
FIG. 1 is a perspective view illustrating a lock box mounting assembly and lock box mounted to the hinge-edge of a door in accordance with one embodiment of the subject invention.

Referring now to the drawings, wherein like numerals indicate like parts, and initially the non-lockable bracket of FIG. 1, there will be seen a lock box mounting assembly, generally indicated 10, positioned along the hinge-edge of a door 26 in accordance with a preferred non-lockable embodiment of the invention. A lock box, generally indicated 12, may be removably mounted to lock box mounting assembly 10 by a shackle 14. Before describing the elements of the subject lock box mounting assembly 10, it may be helpful to briefly describe the usage and structural design of lock boxes.

Lock boxes are used extensively in the real estate industry in connection with the showing of real estate property. Conventional lock boxes typically include a hollow housing 16 having an inner cavity dimensioned to store a front door key 18 to the listed property. Realtors typically secure a lock box somewhere on the property so that a key to the property is always on the premises in a locked, safe place. The local real estate board issues keys to the lock box to realtors. In one type of lock box, such as the one shown in FIG. 1, the issued lock box key fits into a lock mechanism 20 to open and close a hinged door 22 on lock box 16 about a hinge 24. Agents having a lock box key may arrive at a home, open the lock box to access the homeowner's key, and then use the homeowner's key to open the door and show the home. Thus, the lock box enables designated real estate agents to enter property without the necessity of providing each agent with a key to the property itself.

The subject lock box mounting assembly 10 enables a realtor to mount a lock box in a clearly visible, accessible place on the listed property, and yet provides a high degree of security. As shown in FIG. 1, lock box mounting assembly 10 is positioned between door 26 and door jamb 28. The subject lock box mounting assembly 10 generally comprises a U-shaped bracket 30 having an outer leg portion 32, and inner leg portion 34, and a central portion 36 connecting outer leg 32 and inner leg 34. Central portion 36 extends through the reveal space between the hinge-edge of door 26 and door jamb 28 when door 26 is in a closed position.

Figure 2:
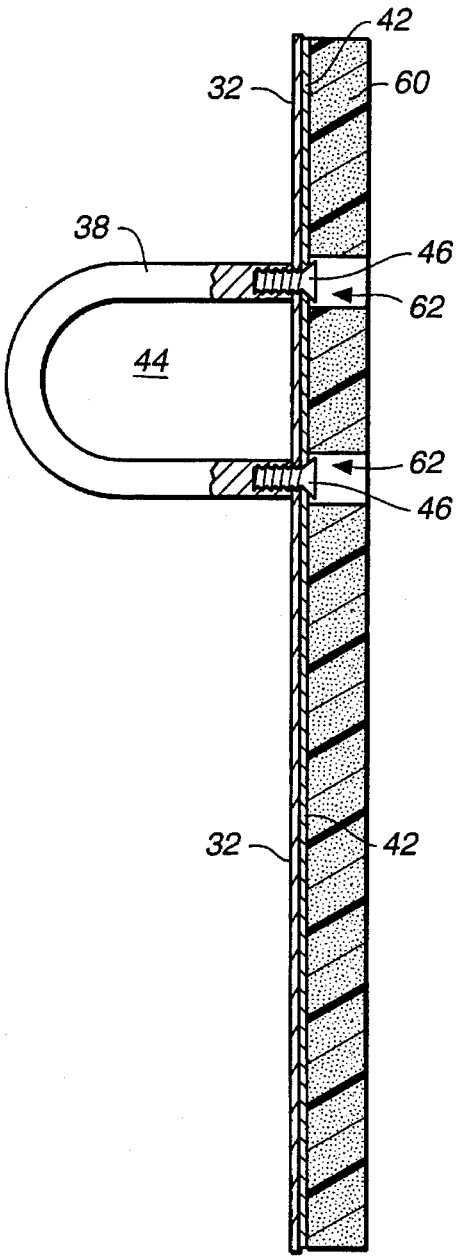
FIG. 2 is a side elevation view, in cross section, illustrating the attachment of a lock box mounting eye element to a backing member and liner in accordance with the subject invention.

Lock box mounting assembly also includes a backing plate 42 as shown in FIG. 2. A lock box mounting eye element 38, preferably U-shaped in form, is mounted to backing plate 42. Eye element 38 is vertically oriented with respect to a front side 40 of outer leg 32 and, thus, forms a horizontal opening 44 dimensioned to receive lock box shackle 14. Eye element 38 is releasably mounted to backing plate 42 by screws 46. Alternatively, eye element 38 may be adhesively attached, welded, or otherwise mounted to backing plate 42.

In a preferred embodiment, a buffer member 60 is adhesively attached to backing plate 42. Buffer 60 protects door 26 from being scratched by backing plate 42. Buffer 60 is preferably composed of a relatively hard, elastomeric material, such as natural or synthetic rubber, and measures approximately 0.5 inches in thickness. Channels 62 are bored through buffer 60 to permit insertion of screws 46 into backing plate 42.

In order to mount lock box shackle 14 to mounting assembly eye or shackle 38, screws 46 can be removed, shackle or eye 38 mounted over shackle 14 and the screws remounted to backing plate 42. Alternatively, lock box shackle 14 can be releasably coupled to box 16 by a lock mechanism (not shown) which is opened by a key or combination. It is also possible to permanently mount box 16 to outer leg 32 by a structure other than shackle 14. Thus, welding or integrally forming box 16 as a part of outer leg 32 is within the scope of the present invention.

Turning back to FIG. 1, outer leg includes at least one, and preferably two, eye-receiving slots **48*a* and 48*b* positioned intermediate the upper and/or lower periphery of outer leg 32. More specifically, one eye-receiving slot 48*a* is positioned proximate an upwardly facing edge 50 of outer leg 32, and the other slot 48*b* is positioned proximate a downwardly facing edge 51. In an operative context, backing plate is mounted behind outer leg 32 so that eye element 38 extends outwardly from outer leg 32 through one of eye-receiving slots 48. For an aesthetically pleasing look, eye element 38** may be formed from brass.

Bracket 30 is constructed to prevent lock box 16 from swinging into door 26 and denting or marring the door or door jamb. Outer leg 32 has length and width dimensions larger than the length and width of a side of lock box 16 facing outer leg 32. In addition, when backing plate 42 is mounted behind outer leg 32, eye element 38 extends through outer leg 32 at a position sufficiently close to outer leg edge 50, or edge 51 depending on whether the door is right-hand hinged or left-hand hinged as will be explained below, to prevent lock box 16 from coming into contact with door 26.

Lock box mounting assembly 10 may be easily mounted to the hinge-side of door 26. Inner leg 34 includes at least one, and preferably two, hinge-receiving slots **52*a* and 52*b* dimensioned to receive a door hinge (not shown) for vertically supporting bracket 30 on the door hinge. Slots 52*a* and 52*b* permit lock box mounting assembly 10 to be mounted to either a right-hand hinged or left-hand hinged door. More specifically, as seen in FIG. 1, slot 52*a* defines a vertically extending, upwardly-facing slot capable of receiving a door hinge when lock box mounting assembly 10 is positioned in a left-hand hinged door. Slot 52*b* defines a vertically extending, downwardly facing slot for positioning on a right-hand hinged door. Slots 52*a* and 52*b* are positioned immediately proximate central portion 36 corresponding to the location of the door hinges. Each slot 52*a* and 52*b* includes a surface 54*a* and 54*b***, respectively, formed for engaging a door hinge.

Figure 3:
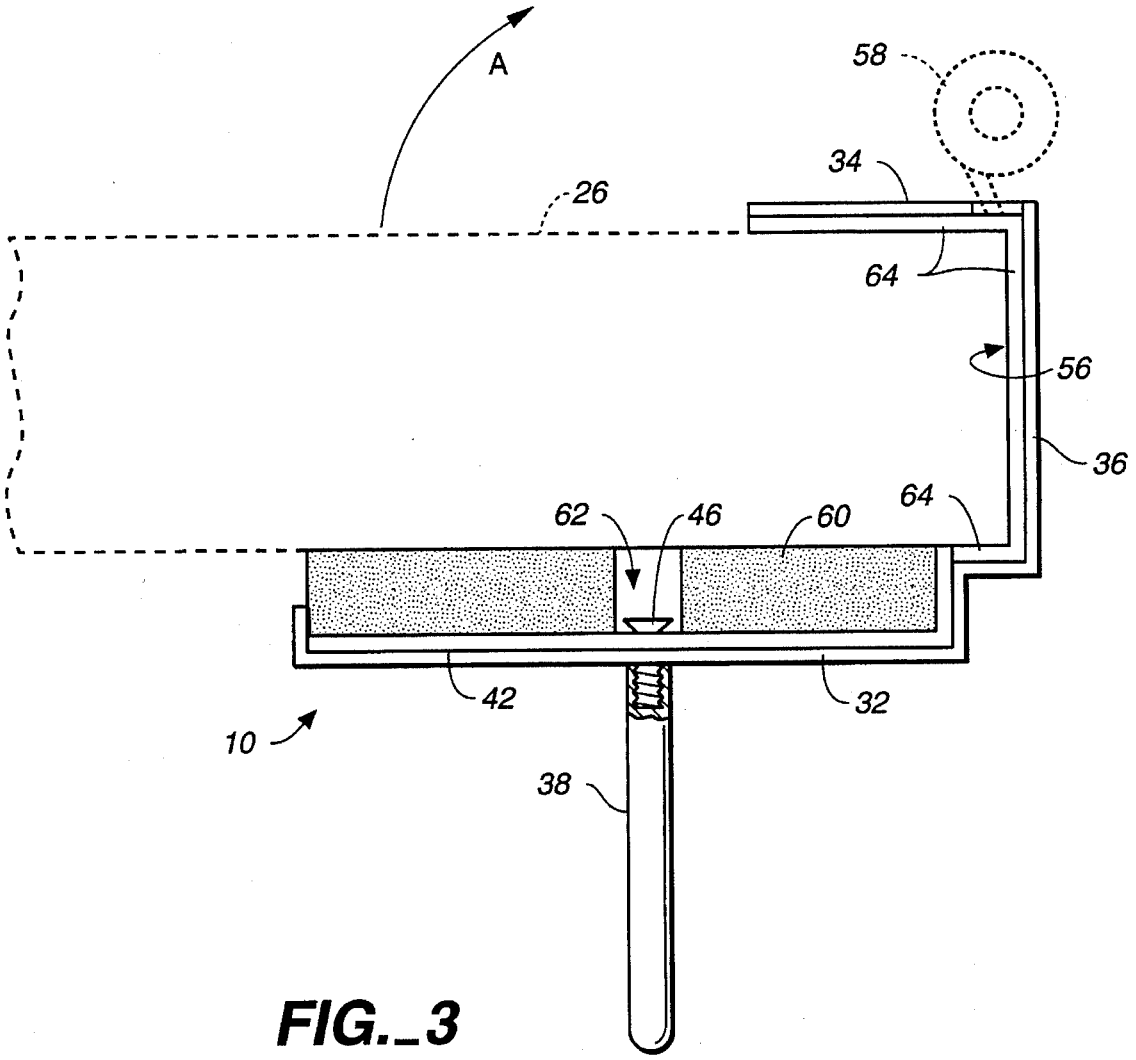
FIG. 3 is a fragmentary, top plan view of the lock box mounting assembly mounted to a hinge-edge of a door.

FIG. 3 illustrates lock box mounting assembly 10 mounted to a right-hand hinged door. To mount lock box mounting assembly 10 to door 26, door 26 is swung to an open position in the direction indicated by arrow A, and U-shaped bracket 30 is slid between door 26 and door jamb 28 (show in FIG. 1) and urged along the inner end 56 of door 26 to a resting position atop a door hinge 58. The front door of a typical home pivots about three hinges. Lock box bracket 30 preferably rests atop the middle hinge of the door at a vertical height which may be easily reached by an average-sized adult. In other embodiments of the invention, however, lock box mounting assembly 10 may clamp onto door 26 by friction or suction, without resting on a door hinge.

Bracket 30 may be formed from a metallic material, for example brass, or from molded plastics. If bracket is formed from a metallic material which may mar the door, a resilient padding or liner 64 is applied to the inside surface of inner leg 34, central portion 36, and at least part of outer leg 32. Liner 64 is preferably composed of an elastomeric material. The resilient character of liner 64 assists in clamping bracket 30 to door 26. No protective liner is necessary where bracket 30 is composed of plastic, although the clamping feature of the liner material makes it desirable.

Another feature of the subject lock box mounting assembly 10 consists of an advertising plate 66 mounted to front side 40 of outer leg 32 above eye element 38. The listing realtor's name, or other relevant information, may appear on advertising plate 66.

Figure 4:
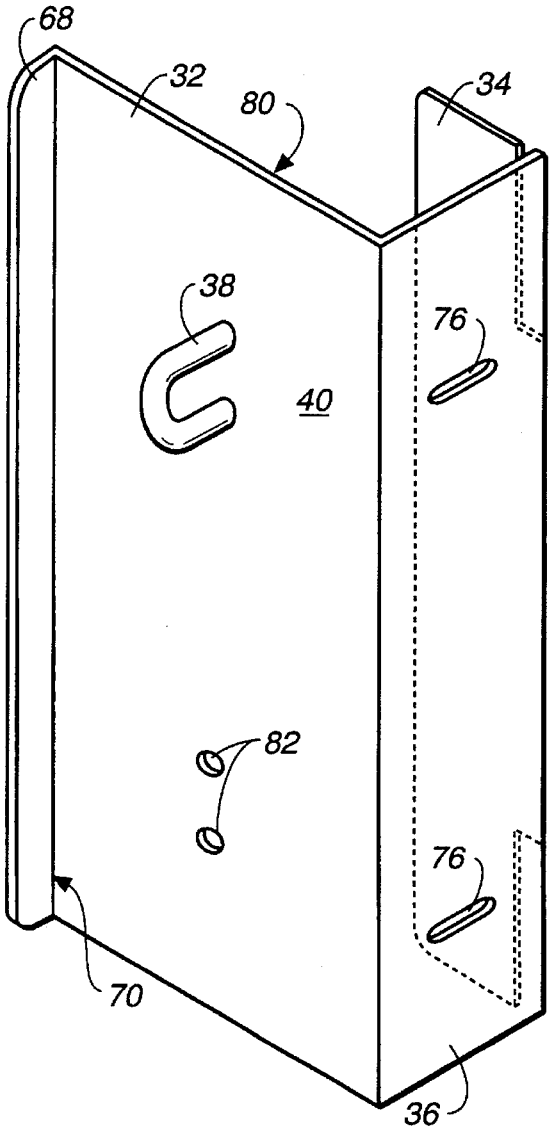
FIG. 4 is a perspective view of an alternative embodiment of the subject lock box mounting assembly.
Figure 5:
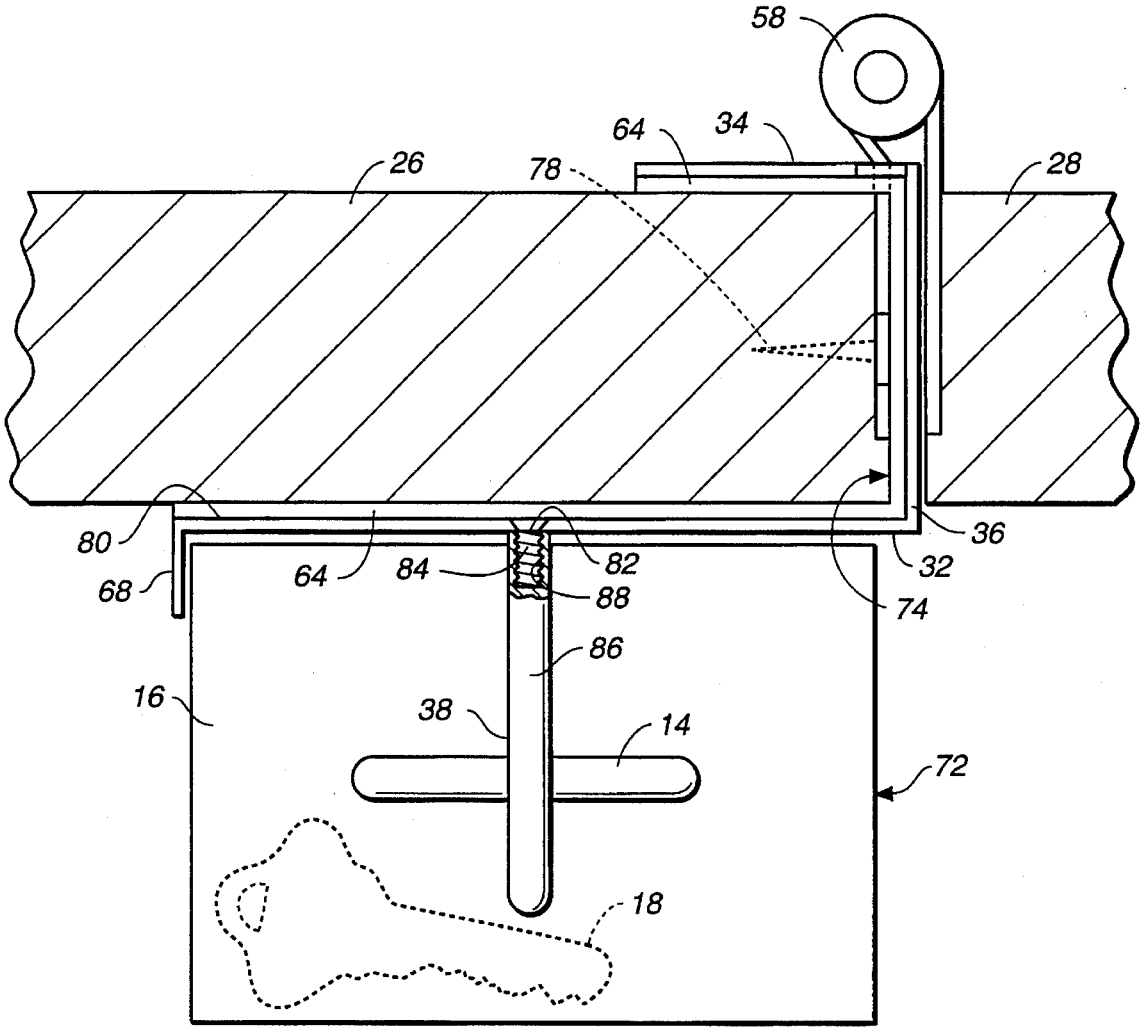
FIG. 5 is a fragmentary, top plan view, in cross section, of the lock box mounting assembly, as shown in FIG. 4, mounted to the hinge-edge of a door and supporting a lock box.

Turning to FIGS. 4 AND 5, lock box mounting assembly 10 may also include a flange 68 which protrudes outwardly from front side 40 of outer leg 32. Flange 68 preferably extends vertically along an outer edge 70 of outer leg 32. Flange 68 is designed to contact a side 72 of lock box 16 in the event lock box 16 should swing outward under centrifugal force during opening or closing of door 26. Flange 68 resists any tendency of the relatively heavy lock box 16 to swing out and damage door 26.

FIGS. 4 and 5 also illustrate an alternative method of attaching bracket 30 to the hinged-edge of door 26. Bracket 30 may be fastened to door hinge 58 by a screw assembly. Hinges are normally fastened by screws to the inner edge 74 of a door. In this embodiment, central portion 36 includes at least one, and preferably two, horizontal openings 76 positioned and dimensioned to receive a hinge screw 78. Horizontal openings in central portion 36 are spaced in correspondence with the spacing between hinge screws in a standard door hinge. To more securely mount lock box mounting assembly 10, hinge screws 78 may be inserted through horizontal openings 76 to fasten central portion 36 to the hinge-edge of door 26. Screws 78 prevent bracket 30 from falling away from door 26 when door 26 is in an open position. In addition, the secure fit created by screws 78 prevents bracket 30 from shifting and causing door 26 to close on bracket 30, possibly damaging the door or door frame.

In this alternative embodiment of the subject invention, eye element 38 is secured to an inwardly facing side 80 of outer leg 32. More particularly, outer leg 32 includes eyelets 82 dimensioned to receive screws. Eye element 38 may be releasably attached to outer leg 32 by inserting a screw 84 through an eyelet 82 and into a leg portion 86 of U-shaped eye element 38, as shown in FIG. 5. In this embodiment, each leg portion of U-shaped eye element 38 includes a threaded aperture 88 for receiving a screw 84. Alternatively, eye element 38 may be welded or adhesively attached directly to outer leg 32.

Figure 6:
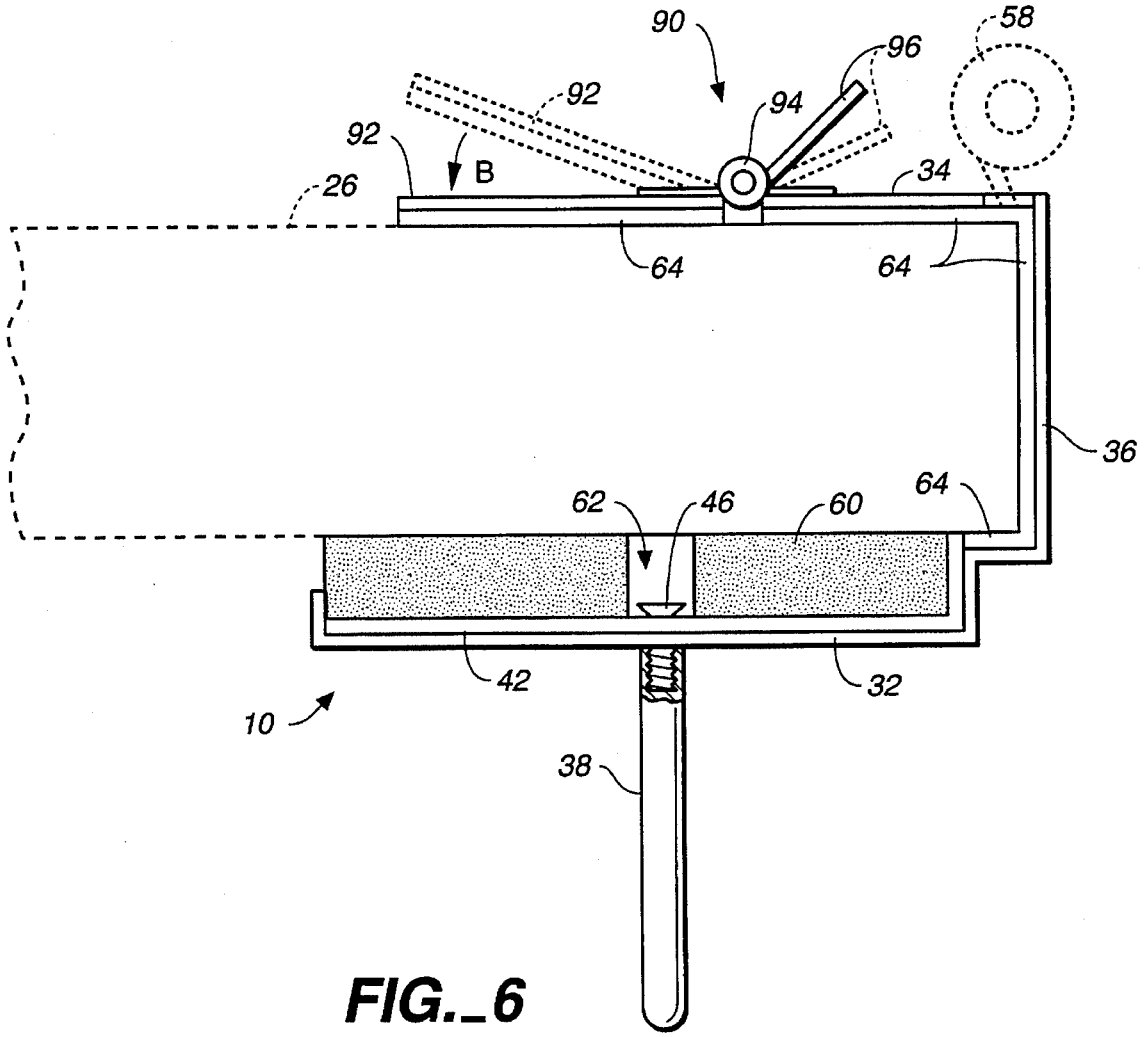
FIG. 6 is a fragmentary, top plan view of a third embodiment of the subject lock box mounting assembly mounted to the hinge-edge of a door.

As shown in FIG. 6, a third non-lockable embodiment of the subject lock box mounting assembly 10 includes a clamping mechanism, generally indicated 90, hingedly mounted to inner leg 34 for retaining lock box mounting assembly 10 in a fixed, stable, vertical position on door 26. Clamping mechanism 90 preferably includes a spring biased arm 92 resiliently biased toward outer leg 32 by a spring biasing member 94, such as a coil spring. Spring biasing member 94 forces arm 92 into engagement with door 26, as indicated by arrow B. Outer leg 32 and arm 92 cooperate to clamp lock box mounting assembly 10 to door 26.

Clamping mechanism 90 further includes a manually engageable lever 96 for pivoting arm 92 about biasing member 94 from the solid line position shown in FIG. 6 to the dotted line position shown in FIG. 6. Lever 96 enables a user to pivotally release arm 92 from door 26 and then move mounting bracket 30 along the hinge-edge of door 26. Clamping mechanism 90 insures that, when door 26 is in an open position, mounting bracket 30 will remain in a stable fit between door 26 and door jamb 28.

Referring now to FIGS. 7 through 11, a lock box mounting bracket assembly and method which allows the mounting bracket to be locked on the door can be described. The bracket assembly, generally designated 101, is comprised of two U-shaped bracket members 102 and 103, which again are formed for mounting to the hinge-edge 104 of door 106 in the reveal space between the door and the door jamb 107. Since one of the major security problems in connection with the use of lock boxes is the realtors themselves, lock box mounting assembly 101 is formed to enable the same to be locked to hinge-edge 104 of door 106. Thus, with the mounting bracket assembly of FIGS. 7 through 11, the realtor cannot unlock the lock box and then throw the entire lock box and bracket away, because the bracket is secured to the door hinge and the lock box is not removable from the bracket using the same key or combination which provides access to the house key.

Each hinge bracket 102 and 103 includes an inner leg portion 108, an outer leg portion 109 and a connecting central portion 111 which is dimensioned to extend through the reveal space between the door and jamb. The outer leg portion of at least one of the brackets, and preferably both brackets 102 and 103, includes an eye-defining structure, here shown as an outwardly extending flange 112 formed with an opening, and in this case two openings 113 therein. Each of openings 113 is preferably dimensioned to receive a lock box shackle member 114 therethrough. This enables coupling of lock box 116 to each flange 112 of the respective bracket members 102 and 103, and enables coupling of the bracket members to each other.

In order to enable locking of assembly 101 to door hinge 117, at least one, and preferably each of bracket members 102 and 103 includes a hinge-receiving structure, such as a slot 118 extending vertically and opening to an edge of the bracket member and dimensioned for slidable mounting over an edge 119 of door hinge 117. The bracket members are further formed for opening of door 106 while mounted over hinge 117. Thus, the lock box mounting brackets of the present invention do not interfere with normal opening and closing of door 106.

In order to provide enhanced security, the hinge-receiving structure or slots 118 are formed to encircle a sufficient portion of door hinge 117 to prevent removal of the bracket members from the door hinge upon securement of the hinge-receiving slots to door hinge 117, for example, by shackling the two flanges 112 together using lock box shackle 114.

Figure 7:
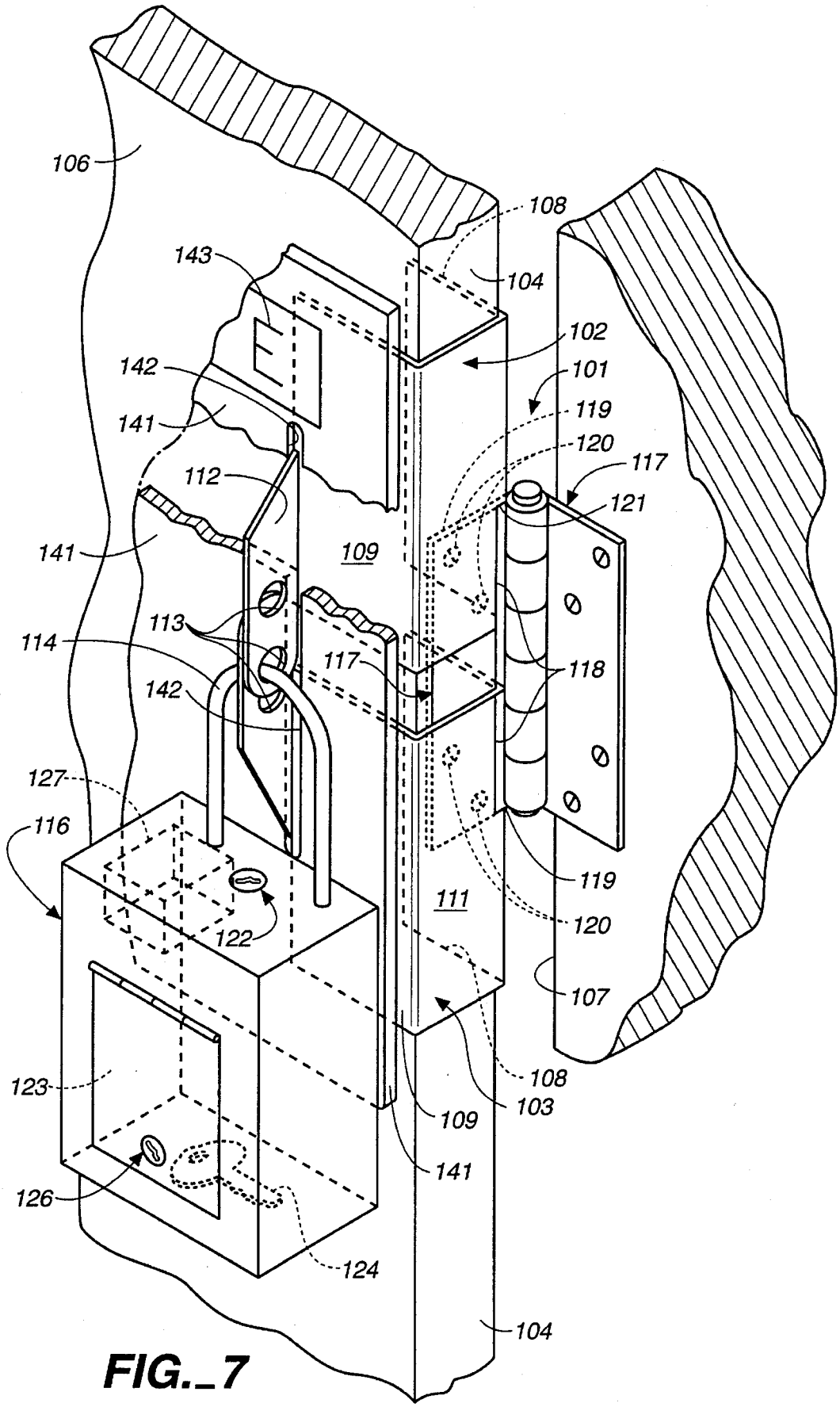
FIG. 7 is a top perspective view illustrating another embodiment of the lock box mounting bracket assembly of the present invention which is shown locked around a door hinge.

As can be seen from FIG. 7, therefore, the lock box mounting bracket assembly of the present invention may be easily and very securely mounted to hinge-edge 104 of door 106. Door 106 is opened and upper bracket 102 is mounted on the door edge and vertically displaced downwardly on the door until slot 118 passes over door hinge 107 with the downwardly facing shoulder 121 resting on the upwardly facing upper edge 119 of hinge 117. The lower bracket member 103 similarly is placed on the door edge and displaced upwardly until slot 118 passes over the downwardly facing hinge-edge 119. This brings the flanges 112 in close abutting relationship to each other so that at least one opening 113 in each of flanges 112 can be aligned with a similar opening in the other bracket member flange. Once aligned, shackle 114 is placed through the aligned openings 113 and a first lock assembly 122 is used to lock the shackle 114 in place.

Moreover and very importantly, the bracket assembly of the present invention preferably covers one, and preferably all, of hinge screws or fasteners 120 in door edge 104. This prevents removal of the bracket assembly by removing the hinge from the door. Removal of hinge 117 from jamb 107 would still require that the entire door be removed because the bracket assembly would still be locked around the door hinge.

Lock box 116 further has a movable panel or door 123 which provides access to an interior cavity in which a key 124 can be stored. Movable door or panel 123 is secured in a locked position by a second lock assembly 126. Individual realtors, therefore, can be given a key or other lock-actuated mechanism for second lock assembly 126, but they are not given a key or lock-actuating mechanism for the first lock assembly 122. As used herein, the expression "lock-actuating mechanism" shall include mechanical keys, magnetic cards or keys, and combinations. As shown in the drawing, the first and second lock assemblies 122 and 126 are both keyed with conventional tumbler assemblies (not shown). Various electronic lock boxes, however, are provided, and the electronic lock box of U.S. Pat. No. 4,609,780, is particularly useful in combination with the bracket assembly of the present invention. It includes two locking mechanisms and further includes a battery-powered storable memory and program device, schematically shown at 127 in FIG. 7, which is capable of storing data or information as to when the second lock mechanism was opened and as to the identity of the key or lock-actuating mechanism used to open the lock box. The details of construction of such programmable lock boxes are well known in the industry and described in more detail in U.S. Pat. No. 4,609,780, and will not be described further herein.

Figure 8:
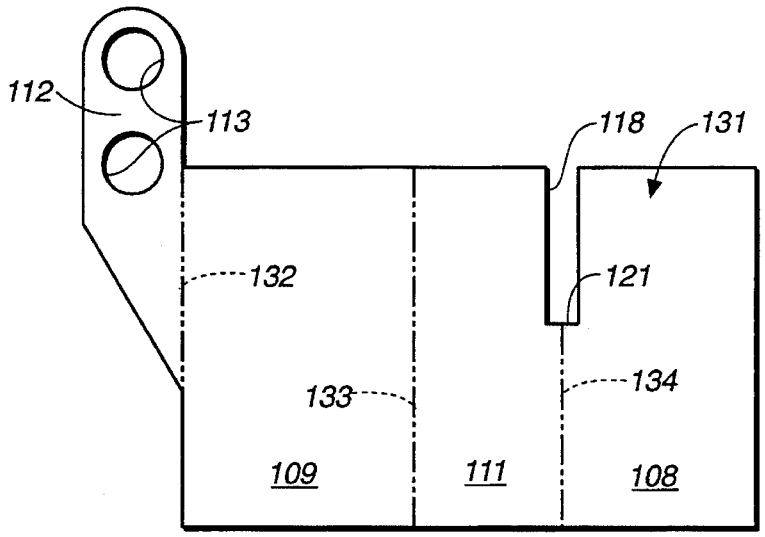
FIG. 8 is a plan view of a sheet metal member prior to bending and suitable for making both the bracket members of the assembly of FIG. 7.

Referring now to FIGS. 8 through 11, further details of the construction and method of forming the bracket members 102 and 103 comprising the mounting assembly 101 of the present invention can be described. FIG. 8 shows a pattern suitable for forming both of brackets 102 and 103 from a sheet metal member. The bracket members 102 and 103 can have substantially identical peripheries or be formed from substantially the same pattern, which pattern is shown in FIG. 8. A unitary or continuous monolithic sheet metal member 131 can have a generally rectangular shape with a hinge receiving slot 118 formed proximate one side and eye-defining flange 112 with openings 113 formed proximate the opposite edge. For upper bracket 102, sheet metal member 131 is folded into the page at fold line 132. The bracket is then folded out of the page at fold line 133 and then is folded toward flange 112 at fold line 134.

Figure 9:
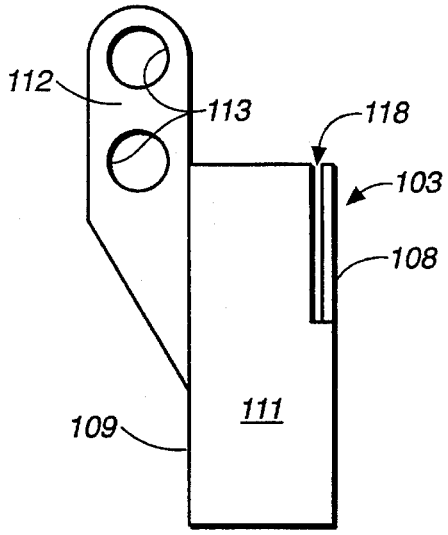
FIG. 9 is an end elevation view of the lower bracket member made from the member of FIG. 8.
Figure 10:
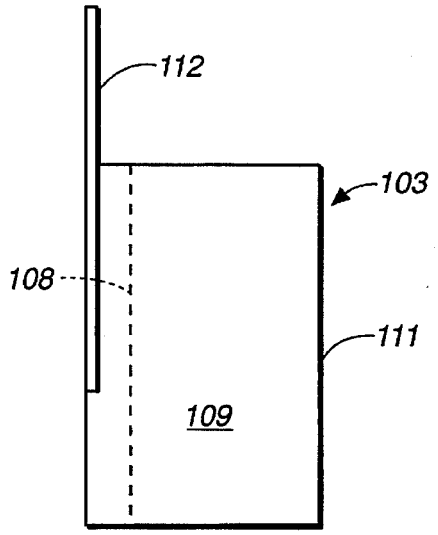
FIG. 10 is a front elevation view of the bracket member of FIG. 9.
Figure 11:
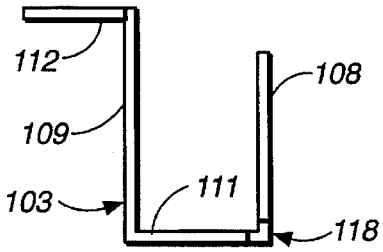
FIG. 11 is a bottom plan view of the bracket member of FIG. 9.

In order to form lower bracket 103, the flange 112 is folded out of the page at fold line 132. The body is folded into the page at fold line 133 and then finally folded toward the flange 112 at fold line 134. FIGS. 9 through 11 illustrate the pattern of FIG. 8 as folded for bracket 103. As will be seen from FIG. 7, the flanges 112 on the upper and lower bracket members 102 and 103 must slightly overlap in order to have aligned holes which shackle 114 can pass through. The size of slot 118 can be sufficiently large to allow relative shifting between the bracket inwardly and outwardly of door edge 104 to allow one of the flanges 112 to be inside the other. Alternatively, the fold line 132 can be slightly adjusted for one bracket as compared to the other to give clearance.

In the bracket assembly of FIG. 7, it is preferable that protection for the front surface of door 106 is provided by a door protection member 141 formed with a slot or elongated opening 142 therein which is dimensioned to receive the combination of thicknesses of both flanges 112. Opening 142 does not extend to either the upper or lower edge of the protection member 141, and accordingly, when the protection member is mounted over flanges 112 and shackle 114 passed through an eye on each of the flanges, the protection member is also locked onto the door underneath lock box 116. It is further preferable that the protection member include advertising indicia 143 provided, preferably permanently, thereon at a visible position when the lock box is mounted to the bracket assembly 101. In this case, the advertising indicia 143 is provided in an area above the slot 142 for bracket flanges 112.

In order to accommodate hinges of varying height, it is preferable that flanges 112 include a plurality of eyes 113 therein so that openings in each flange 112 can be aligned which position the slots 118 sufficiently close to the hinge edges 119 that the hinge is captured or encircled in a manner which will not allow the assembly to be removed. The slot 142 in protection member 141 must be sufficiently large to accommodate the maximum separation between brackets.

Having described the lockable mounting bracket of the present invention, the method of using the same can be described. The present method includes the steps of a lock box mounting bracket assembly 101 which is positioned on a hinged-edge 104 of a door 106 to the door hinge 117 using a lock assembly 122 carried by lock box 116 and having a first lock actuating mechanism, such as a key or combination. The next step is to lock lock box 116 to mounting bracket assembly 101 using the first lock assembly 122. Preferably, the step of locking the lock box bracket to the hinge and locking the lock box to the bracket are simultaneously accomplished in the method of the present invention since passing the shackle through the flange eyes 113 simultaneously effects locking of the lock box to the flanges and locking of the bracket members 102 and 103 to hinge 117. The final step of the method of the present invention is locking a movable member, such as door 123, provided on lock box 116 in a closed position to secure a door unlocking device to the lock box using a second lock assembly 126 having a second lock actuating mechanism, such as a second key or combination. Prior to the step of locking the lock box bracket to the hinge, it is preferable that the present method include the step of substantially encircling door hinge 117 with two relatively movable mounting bracket members 102 and 103 which extend through the reveal space between the door 106 and jamb 107. In a most preferred form, lock box 116 has a memory device 127 coupled to lock assembly 126 so that data relating to the identity of the person unlocking lock assembly 126 can be stored and thereafter downloaded as needed.

It will be understood that the subject lock box assembly may be used in connection with various types of property, such as homes, apartments, places of business or the like. In addition, lock boxes may be used in industries other than real estate. It may be desirable to mount a lock box to a home so that repairmen or servicemen may enter the home and perform a service while the occupant is away.

In addition, it will be understood that various lock box designs may be used in connection with the subject lock box mounting assembly. For example, a lock box having a dial-type, combination lock mechanism may be releasably mounted to lock box mounting assembly. In such a case, a real estate agent would need the combination which opens the dial-type lock mechanism to access the front door key.

In describing the invention, reference has been made to a preferred embodiment and illustrative advantages of the invention. Those skilled in the art, however, and familiar with the instant disclosure of the subject invention, will recognize additions, deletions, modifications, substitutions, and other changes which will fall within the purview of the subject invention and claims.

What is claimed is:

1. A lock box mounting bracket comprising:

at least one U-shaped bracket formed for mounting to a hinge-edge of a door between said door and a door jamb, said U-shaped bracket including an outer leg portion, an inner leg portion and a central portion connecting said outer leg portion and said inner leg portion and formed to extend through a reveal space between said hinge-edge of said door and said door jamb when said door is in a closed position, said outer leg portion having a lock box mounting eye-defining structure extending outwardly therefrom, said eye-defining structure having an opening therein dimensioned to receive a lock box shackle member therethrough for coupling of a lock box to said bracket, and said bracket further being formed with a hinge-receiving structure extending vertically and opening to an edge of said bracket, said hinge-receiving structure being dimensioned for slidable mounting over an edge of a door hinge, and said bracket and said hinge-receiving structure being further formed for opening of said door while said bracket is mounted on said door hinge.

2. The lock box mounting bracket as defined in claim 1 wherein, said hinge-receiving structure is formed to encircle a sufficient portion of said door hinge to prevent removal of said bracket from said door hinge upon securement of said hinge-receiving structure to said door hinge.

3. The lock box mounting bracket as defined in claim 2, and a U-shaped second bracket formed for mounting to said hinge edge of said door and including an outer leg portion, an inner leg portion and a central leg portion connecting said outer leg portion and said inner leg portion and formed to extend through said reveal space when said door is in a closed position.

4. The lock box mounting bracket as defined in claim 2, and a substantially planar door protection member formed for mounting over said eye-defining structure and formed for securement to said bracket upon mounting of said lock box shackle member through said opening.

5. The lock box mounting bracket as defined in claim 4 wherein, said substantially planar door protection member is formed with a slot therein terminating short of the periphery of said door protection member to receive said eye-defining structure therethrough.

6. The lock box mounting bracket as defined in claim 4 wherein, said substantially planar door protection member includes advertising indicia permanently provided thereon at a visible position thereon when said lock box is mounted to said eye-defining structure.

7. The lock box mounting bracket as defined in claim 2, and a lock box having a movable shackle mounted through said opening, said lock box having a first lock assembly locking said shackle in a closed position to secure said shackle to said eye-defining structure, a housing defining a key-receiving cavity therein with a movable panel providing access to said cavity, and a second lock assembly formed to be unlocked by a differing unlocking device than the device unlocking said first lock assembly and mounted to lock said movable panel to said housing to prevent access to said cavity.

8. The lock box mounting bracket as defined in claim 7 wherein, said second lock assembly has a memory device operatively associated therewith and formed to be responsive to unlocking of said second lock assembly to store data in said memory device as to the identity of the device unlocking said second lock assembly.

9. The lock box mounting bracket as defined in claim 2 wherein, said bracket is further formed to cover said door hinge at a plurality of locations where said door hinge is connected to said door to thus prevent removal of said door hinge from said door.

10. The lock box mounting bracket as defined in claim 9 wherein, said bracket is formed to cover at least one fastener used to fasten said door hinge to said door.

11. A lock box mounting bracket comprising:

a U-shaped first bracket formed for mounting to a hinge-edge of a door between said door and a door jamb, said first bracket including an outer leg portion, an inner leg portion and a central portion connecting said outer leg portion and said inner leg portion and formed to extend through a reveal space between said hinge-edge of said door and said door jamb when said door is in a closed position, said outer leg portion having a lock box mounting eye-defining structure extending outwardly therefrom, said eye-defining structure having an opening therein dimensioned to receive a lock box shackle member therethrough for coupling of a lock box to said first bracket, and said first bracket further being formed with a hinge-receiving structure extending vertically and opening to an edge of said first bracket, said hinge-receiving structure being dimensioned for slidable mounting over an edge of a door hinge, and said first bracket and said hinge-receiving structure being further formed for opening of said door while said first bracket is mounted on said door hinge; and a U-shaped second bracket formed for mounting to said hinge-edge of said door and including an outer leg portion, an inner leg portion and a central leg portion connecting said outer leg portion and said inner leg portion and formed to extend through said reveal space when said door is in a closed position, said second bracket is formed with a hinge-receiving structure extending vertically and opening to an edge of said second bracket enabling mounting of said second bracket over an edge of said door hinge opposite said edge of said door hinge on which said first bracket is mounted.

12. The lock box mounting bracket as defined in claim 11 wherein, the hinge-receiving structures on a combination of said first bracket and said second bracket are formed to encircle a sufficient portion of said door hinge to prevent removal of said first bracket and said second bracket from said door hinge upon securement of said hinge-receiving structures to said door hinge.

13. The lock box mounting bracket as defined in claim 11 wherein, said second bracket is formed with a lock box mounting eye-defining structure extending outwardly of said outer leg portion and having an opening therein dimensioned and positioned for receipt of a lock box shackle member therethrough while said shackle also extends through said eye-defining structure on the first-named bracket to secure said second bracket to said first bracket while the brackets are mounted to opposite edges of said door hinge.

14. The lock box mounting bracket as defined in claim 13 wherein, said eye-defining structure on the first bracket and said eye-defining structure on said second bracket are each formed by outwardly extending flanges formed from a unitary sheet of material which is continuous with the first bracket and said second bracket, respectively.

15. The lock box mounting bracket as defined in claim 14 wherein, each of said flanges is formed with a plurality of vertically spaced openings therein to accommodate door hinges of various heights.

16. The lock box mounting bracket as defined in claim 13, and a lock box having a movable shackle mounted through said opening in the first bracket and said opening in said second bracket, said lock box having a first lock assembly locking said shackle in a closed position to secure said shackle to said eye-defining structure, a housing defining a key-receiving cavity therein with a movable panel providing access to said cavity, and a second lock assembly formed to be unlocked by a differing unlocking device than the device unlocking said first lock assembly and mounted to lock said movable panel to said housing to prevent access to said cavity.

17. The lock box mounting bracket as defined in claim 16 wherein, said second lock assembly has a memory device operatively associated therewith and formed to be responsive to unlocking of said second lock assembly to store data in said memory device as to the identity of the device unlocking said second lock assembly.

18. The lock box mounting bracket as defined in claim 11 wherein, the first bracket and said second bracket are each formed with a slot dimensioned for sliding receipt over an opposite edge of said door hinge.

19. The lock box mounting bracket as defined in claim 11 wherein, the first bracket and said second bracket are each formed from a sheet metal and have substantially identical peripheral patterns, with the brackets being bent in opposite directions along vertically extending fold lines to enable mounting to opposite edges of said door hinge.

20. A lock box mounting bracket comprising:

a least one U-shaped bracket formed for mounting to a hinge-edge of a door between said door and a door jamb, said U-shaped bracket including an outer leg portion, an inner leg portion and a central portion connecting said outer leg portion and said inner leg portion and formed to extend through a reveal space between said hinge-edge of said door and said door jamb when said door is in a closed position, said outer leg portion having a lock box mounting eye-defining structure extending outwardly therefrom, said eye-defining structure having an opening therein dimensioned to receive a lock box shackle member therethrough for coupling of a lock box to said bracket, said bracket further being formed with a hinge-receiving structure extending vertically and opening to an edge of said bracket, said hinge-receiving structure being dimensioned for slidable mounting over an edge of a door hinge, and said bracket and said hinge-receiving structure being further formed for opening of said door while said bracket is mounted on said door hinge, said bracket includes a pair of hinge-receiving slots extending vertically proximate said central portion and said inner leg portion, said slots opening to opposed upper and lower edges of said bracket, and said central portion is formed with a pair of horizontally extending screw-receiving slots positioned relative to said hinge-receiving slots to position said screw-receiving slots over a screw provided in a door hinge.

21. The lock box mounting bracket as defined in claim 20 wherein, said eye-defining structure is carried by a backing plate removably mounted behind said outer leg portion;

said outer leg portion is formed with a pair of vertically spaced slots therein proximate upper and lower edges of said outer leg portion, said slots each being dimensioned to receive a mounting element therethrough; and said mounting element being positioned to extend through one of said slots.

22. The lock box mounting bracket as defined in claim 20 wherein, said outer leg portion is provided with an outwardly protruding and vertically extending flange proximate an edge thereof remote from said central portion.

23. In a lock box mounting bracket including a U-shaped body formed for mounting to a hinge-edge of a door between said door and a door jamb, said U-shaped body including an outer leg portion, an inner leg portion and a central portion connecting said outer leg portion and said inner leg portion and formed to extend through a reveal space between said hinge-edge of said door and said door jamb when said door is in a closed position, the improvement in said lock box mounting bracket comprising:

said outer leg portion having a lock box mounting eye element mounted to an inwardly facing side of said outer leg portion and extending outwardly therefrom, said eye element having an opening therein dimensioned to receive a lock box shackle member therethrough for coupling of a lock box to said bracket while mounted on said hinge-edge of said door.

24. The lock box mounting bracket as defined in claim 23 wherein, said outer leg portion is formed with an outwardly protruding element positioned beyond said lock box mounting eye element from said central portion.

25. The lock box mounting bracket as defined in claim 24 wherein, said outwardly protruding element is provided by a vertically extending side flange.

26. The lock box mounting bracket as defined in claim 23 wherein, said outer leg portion is formed with at least one eye-receiving slot intermediate the periphery of said outer leg portion, and said lock box mounting eye element is mounted to a backing member and said backing member is positioned behind said outer leg portion with said lock box mounting eye element dimensioned to and extending outwardly through said eye-receiving slot to mount said eye element to said inwardly facing side of said outer leg portion.

27. The lock box mounting bracket as defined in claim 26 wherein, said outer leg portion includes two eye-receiving slots positioned therein proximate opposed upwardly and downwardly facing edges of said outer leg portion, said backing member is removable from behind said outer leg portion to enable positioning of said lock box mounting eye element through either of said eye-receiving slots to permit said U-shaped bracket to be mounted to a right-hand hinged or a left-hand hinged door with said lock box mounting eye element proximate an upwardly facing edge of said outer leg portion.

28. The lock box mounting bracket as defined in claim 27 wherein, said inner leg portion is formed with a downwardly-opening hinge-receiving slot and an upwardly-opening hinge receiving slot, said hinge-receiving slots each being vertically extending, positioned immediately proximate said central portion and dimensioned to receive a door hinge therein.

29. The lock box mounting bracket as defined in claim 23, and a lock box having a shackle coupled to said eye element, a housing connected to said shackle and dimensioned to receive a key therein, said housing being formed for opening of a portion thereof for insertion and removal of a key and having a lock mechanism releasably locking said housing against opening.

30. The lock box mounting bracket as defined in claim 23 wherein, said inner leg portion includes a hinge-receiving slot opening to a downwardly facing edge thereof and dimensioned to receive a door hinge, and said central portion includes a horizontally extending screw slot dimensioned to receive a hinge screw therethrough for fastening of said central portion to said hinge-edge of said door by a hinge screw, said screw slot being positioned relative to said hinge-receiving slot to be positioned over a screw in said door hinge.

31. The lock box mounting bracket as defined in claim 23 wherein, said inner leg portion includes a movable portion resiliently biased toward said outer leg portion to cooperate with said outer leg portion to clamp said door therebetween, and said movable portion is provided by a clamping member hingedly mounted to said inner leg portion, and a spring biasing element biasing said clamping member toward said outer leg portion by an amount sufficient to secure said mounting bracket to said hinge-edge of said door in a stable vertical position, said clamping member further having a manually engageable portion for pivotal movement of said clamping member in a direction against said spring biasing element to release said mounting bracket for movement along said hinge-edge.

32. A method of mounting a lock box to a door comprising the steps of:

locking a lock box mounting bracket positioned on a hinge-edge of a door to a door hinge of said door using a lock assembly carried by said lock box and having a first lock actuating mechanism;

locking said lock box to said mounting bracket using said first lock assembly; and locking a movable member provided on said lock box in a closed position to secure a door unlocking device to said lock box using a second lock assembly carried by said lock box and having a second lock actuating mechanism differing from said first lock actuating mechanism.

33. A method as defined in claim 32 wherein, said step of locking said mounting bracket to said door hinge and said step of locking said lock box to said mounting bracket are accomplished substantially simultaneously.

34. The method as defined in claim 32 and prior to said step of locking said mounting bracket to said door hinge, substantially encircling said door hinge with two relatively movable mounting bracket members which extend through a reveal space between said door and a door jamb to an outer side of said door.

35. The method as defined in claim 34 wherein, said step of locking said mounting bracket to said door hinge and said step of locking said lock box to said mounting bracket are accomplished by inserting a movable shackle carried by said lock box through an eye provided in each of said mounting bracket members.

36. The method as defined in claim 32 wherein, said step of locking a movable member provided on said lock box is accomplished by locking a movable panel providing access to a cavity in said lock box of sufficient size to store a key for said door therein.

37. The method as defined in claim 32 wherein, said locking steps are accomplished using a lock box having a memory device operatively connected to said second lock assembly and responsive to actuation of said second lock assembly to store data relating to the identity of the person unlocking said second lock assembly, said memory device further being formed for down-loading of said data to permit use of said data.

* * * * *

UNITED STATES PATENT AND TRADEMARK OFFICE

CERTIFICATE OF CORRECTION

PATENT NO. : 5,590,608

DATED : January 7, 1997

INVENTOR(S) : YORE et al.

It is certified that error appears in the above-indentified patent and that said Letters Patent is hereby corrected as shown below:

Column 1, line 39, delete "realtor" and insert therefor --realtors--.

Column 2, line 18, immediately following "4,463,584." begin new paragraph.

Claim 3, column 11, line 12, delete "hinge edge" and insert therefor --hinge-edge--.

Claim 13, column 12, line 46, delete "first-named" and insert therefor --first--.

Claim 20, column 13, line 31, delete "a least" and insert therefor --at least--.

Signed and Sealed this

Eighth Day of April, 1997

Bruce Lehman

*Attest:*

BRUCE LEHMAN

*Attesting Officer*

*Commissioner of Patents and Trademarks*